United States Patent [19]

Körtvélyessy

[11] 4,024,338

[45] May 17, 1977

[54] HIGH TEMPERATURE HEAT INSULATION

[76] Inventor: László Körtvélyessy, P.O. Box 1447, D-419 Kleve, Germany

[22] Filed: Nov. 11, 1974

[21] Appl. No.: 522,929

[30] Foreign Application Priority Data

Nov. 17, 1973 Germany ..... 2357535
May 25, 1974 Germany ..... 2425435

[52] U.S. Cl. ..... 13/20; 13/35
[51] Int. Cl.[2] ..... F27D 1/00; H05B 3/00
[58] Field of Search ..... 13/1, 20, 25, 26, 31, 13/35

[56] References Cited

UNITED STATES PATENTS

| | | | |
|---|---|---|---|
| 3,128,326 | 4/1964 | Hintenberger | 13/22 X |
| 3,162,710 | 12/1964 | Anderson | 13/35 UX |
| 3,558,113 | 1/1971 | Strohmeier et al. | 13/22 UX |
| 3,654,374 | 4/1972 | Scheyer | 13/20 UX |

*Primary Examiner*—R. N. Envall, Jr.
*Attorney, Agent, or Firm*—Martin A. Farber

[57] ABSTRACT

The aim of this invention is to increase the efficiency factor of high-temperature furnaces, primarily of the resistance-heated furnaces (over 2000 K,) as well as to improve the temperature uniformity and to obtain a higher temperature limit, - by using a new construction of the metal-foil system.

2 Claims, 3 Drawing Figures

HIGH TEMPERATURE HEAT INSULATION

It is well known that the heat insulation of metal shielding is considerably better than the heat insulation of metal wool or crumple foil. In recent inventions the problem of high-temperature insulation has been solved by using a metal foil, e.g. in the U.S. Pat. Nos. 3 317 203, 3 409 738, in the German Pat. No. 2 034 200, and in the British Pat. No. 1 047 753. This topic has also been scientifically researched, - see R.P. TYE: "Thermal Conductivity," Academic Press London (1969), and C.K. CRAWFORD: "High-Efficiency High Temperature Radiation Heat-Shields" in the Journal of Vacuum Science and Technology, Vol. 9, No. 1, pages 23–26. The foils lie mainly parallel to the surface to be insulated, with a deviation of 20° at the most. In the known solutions some kind of spacer is used which prevents contact between the foils. The spacers in the cited US-Pats. are for example: Stampings from own material, metal wool, ceramic powder, ceramic fibre or wires, - in other patents there is mention of cermic rings, or wavy welded metal tapes. By these spacers the thickness of the heat insulation is increased. Some spacers necessitate a limit of temperature, e.g. the ceramic powders or fibres melt at a certain temperature, or decomposite catalytically. According to the inventor's practice these spacers also absorb contaminations. Some of these foils reflect on one side and are dirty on the other side after some use. In the case of vacuum furnaces the degassing process is delayed by the higher surface of the heat insulation. Accordingly it is an object of the present invention to provide an improved high-temperature heat insulation, as well as a high-temperature vacuum furnace with heat insulation. The idea of this invention is:

Flat foils are laid tightly together without any spacer. Initial heat-short-circuits or contact points are released by small parts (points) of the foils touching and being sintered, - but such short circuits are negligible. According to the inventor's observations it is practically impossible for an additional foil portion to become sintered onto a prior short-space circuit point, because this short-circuit point heats up the adjacent foils more than normal, thereby causing these foils to expand above the normal level. The additional foil portion moves away from the short-circuit point because it is already fixed by other short-circuit sinter-points, - and the friction forces are also considerable.

FIG. 1 (B) is a cross-section of the insulation of FIG. 1 (A) after a first heating.

An example of the realisation of this invention is shown in the attached FIGS. which are described hereunder.

Figure 1A:
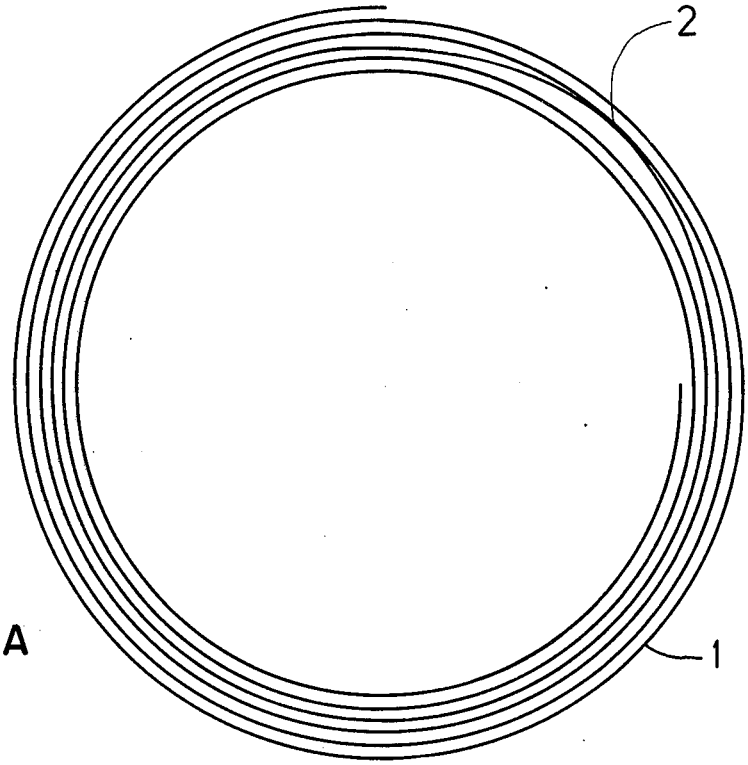
FIG. 1 (A) is a cross-section of an insulation in accordance with the present invention.
Figure 1B:
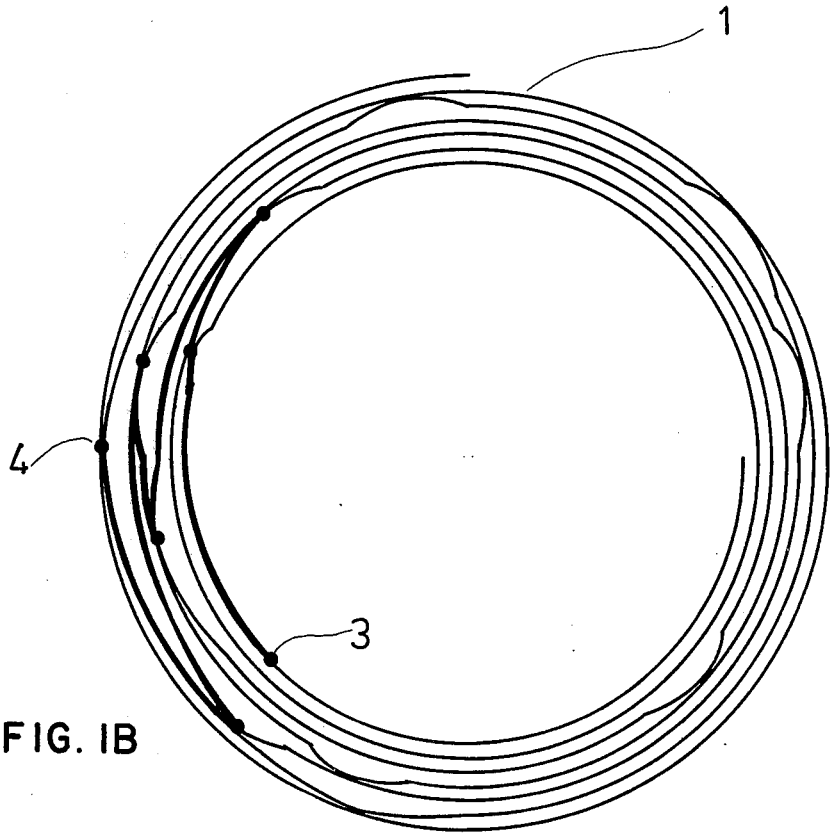

In FIG. 1 (A) a part of the insulation is shown in cross-section. The insulation constituting a coiled foil or plurality of foils is represented by the numeral 1. The foils simply touch one another at adjacent foils or foil windings at point 2 constituting a heat-short-circuit point.

After the first heating the cross section of the insulation appears as shown in FIG. 1 (B). The bent coil shown in FIG. 1 (A) is transformed by the heating; the foils become wavy, some sinter points are developing, (touching points only develop at lower temperatures.) These points are spread statistically, some zigzag paths extend out, e.g. between points 3 and 4 such a path is shown by a thicker line. For better illustration the total thickness of the insulation has been magnified 10 times.

A new possibility of using this improved high-temperature insulation is to heat up the open furnace and/or cool it down. The higher heat losses are low (considered absolutely), and it is possible to minimize these losses by the optical construction described below. At higher temperatures the surface of the heat insulation described above always remains an optical mirror.

The aim of this construction is to shorten the degassing times, and to obtain a better working vacuum in the furnace.

The concept of "no spacer" offers a heat insulation with only 10 percent heat loss with respect to the normal loss. This high profit is partly sacrificed for the better working vacuum in this optical construction.

It is possible to open a part of the heating insulation and its coinciding cold wall section. The insulation and the coinciding cold wall are here described as "wall." The idea of this invention is:

During the pumpdown time, as well as the heating-up time and the cool-down time, part of the furnace wall is removed from the furnace, together with the charge.

Figure 2:
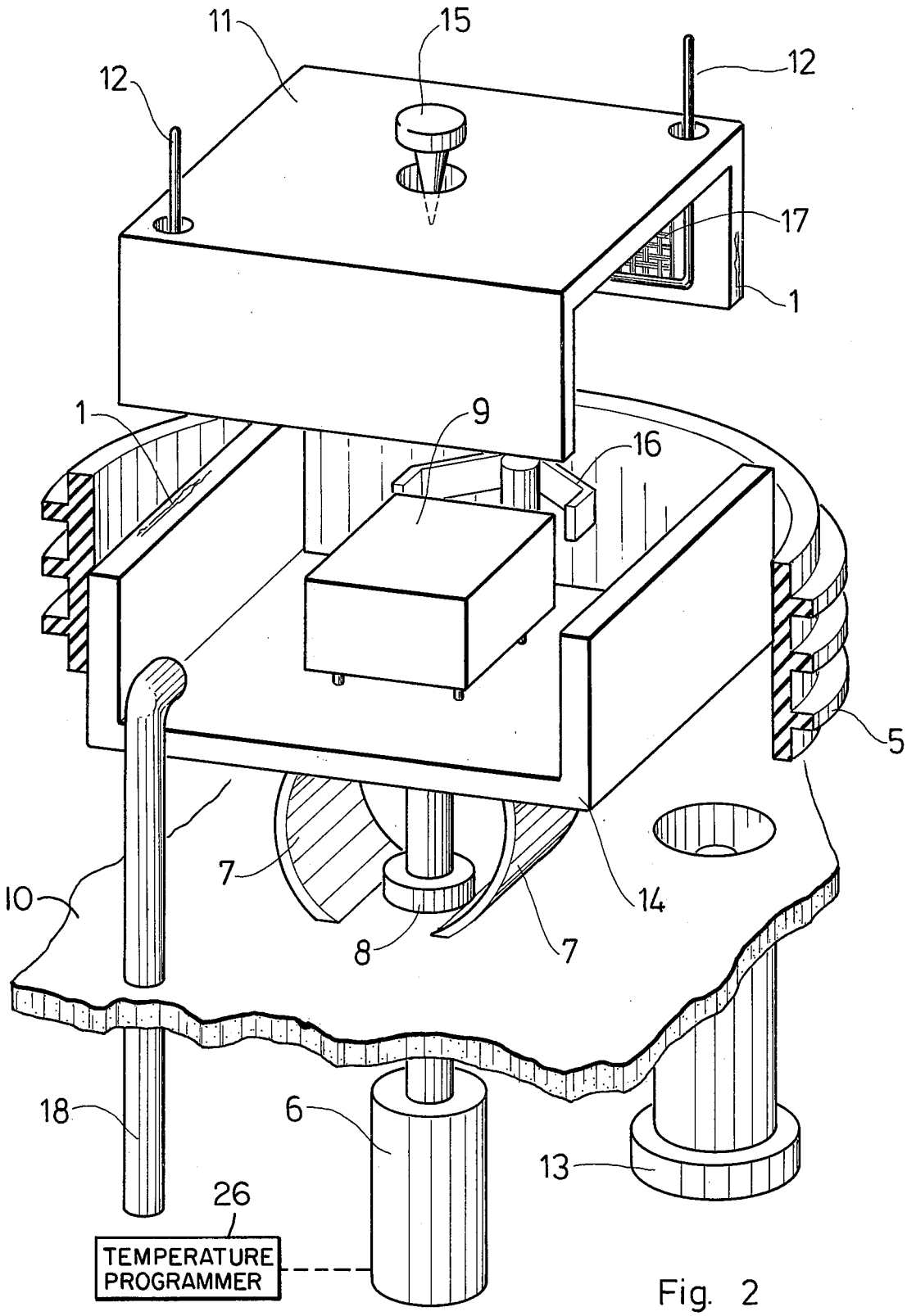
FIG. 2 is a broken away prospective view of a high-temperature furnace in accordance with the present invention.

A possible embodiment is shown in FIG. 2. Here is a complete furnace is illustrated with (or without) the heating insulation described above. The furnace wall consists of two parts, around which a dirt-holding band 5 collects the contaminations of the charge. The lift 6 or bimetal 7 is coupled with the temperature programmer 26 of the furnace.

By means of a continuous elevation movement the furnace is closed between 1000–2500 K. An electrical insulation 8 is provided for electrically separating the upper part of the furnace 11 from the bottom 14. The charge is designated by the numeral 9 and the housing of the vessel by the numeral 10, -the elevating process takes place within the vessel (under vacuum or under controlled atmosphere.) In the furnace 11 there are disposed the electrodes 12 and feed through portions of the heating body. A diffusion pump 13 extends from below the wall 10. The movable wall section, i.e., this bent part or bottom insulation 14 of the heating insulation which carries the charge 9 heats the charge also from below by reflection. The furnace is not contaminated because it radiates only as an infra-red reflector from a distance. It is impossible to get electrical short circuits via dropped particles, because the feed-throughs 12 and the thermocouple 15 are located above. A charge manipulator 16 and a heater 17 are illustrated.

The furnace is easily cleaned from dropped particles by the use of a tangential gas cooler (18).

What I claim is:

1. A heat insulation shield in a sealed housing, preferably used above 2000 K, comprising a plurality of thin metal foils disposed surface-wise adjacent to each other without spacers therebetween and substantially arranged parallel to a surface to be insulated, said foils have portions randomly touching each other by metal-to-metal contact, and that gas with a pressure which ranges up to vacuum is present between the foils.

2. A high-temperature vacuum furnace preferably above 2000 ° k with heat insulation comprising a movable wall section adapted to receive a charge including a bottom insulation comprising, a plurality of thin metal foils disposed surface-wise adjacent to each other without spacers therebetween and substantially arranged parallel to a surface to be insulated, said foils have portions randomly touching each other by metal-to-metal contact, and that gas with a pressure which ranges up to vacuum is present between the foils, said wall section is identical with said bottom insulation, lifting means for moving said wall section together with a charge, temperature programmer means operatively coupled to said lifting means for actuation of the latter.

* * * * *